United States Patent [19]

Morris et al.

[11] Patent Number: 4,848,434

[45] Date of Patent: Jul. 18, 1989

[54] VERTICAL BLIND WITH MOVABLE AUXILIARY ROD SUPPORT

[75] Inventors: John E. Morris, Lake Mills; Ronald G. Darner, Fort Atkinson, both of Wis.

[73] Assignee: Graber Industries, Inc., Middleton, Wis.

[21] Appl. No.: 169,456

[22] Filed: Mar. 17, 1988

[51] Int. Cl.[4] ..... E06B 9/30

[52] U.S. Cl. ..... 160/168.1; 160/900; 160/178.1

[58] Field of Search ..... 160/168.1, 178.1, 173, 160/900

[56] References Cited

U.S. PATENT DOCUMENTS 3,054,446 9/1962 Cayton ..... 160/173
3,500,896 3/1970 Endou .
4,122,884 10/1978 Salzmann .
4,262,728 4/1981 Debs ..... 160/176.1 X
4,293,021 10/1981 Arena ..... 160/900 X
4,332,288 6/1982 Frentzel et al. .
4,657,060 4/1987 Kaucic .

*Primary Examiner*—Blair M. Johnson
*Attorney, Agent, or Firm*—Vernon J. Pillote

[57] ABSTRACT

A vertical blind of the type having a horizontal carriage guide channel and a blind operating rod extending lengthwise of the channel and slat carriages guidably mounted in a first trackway extending lengthwise of the side walls of the channel. One or more movable auxiliary carriages are provided in the guide channel and have guide shoes extending laterally from opposite ends at locations to guidably support the auxiliary carriages in a second trackway on channel vertically offset from the trackway that supports the slat carriages.

12 Claims, 2 Drawing Sheets

Fig. 1.
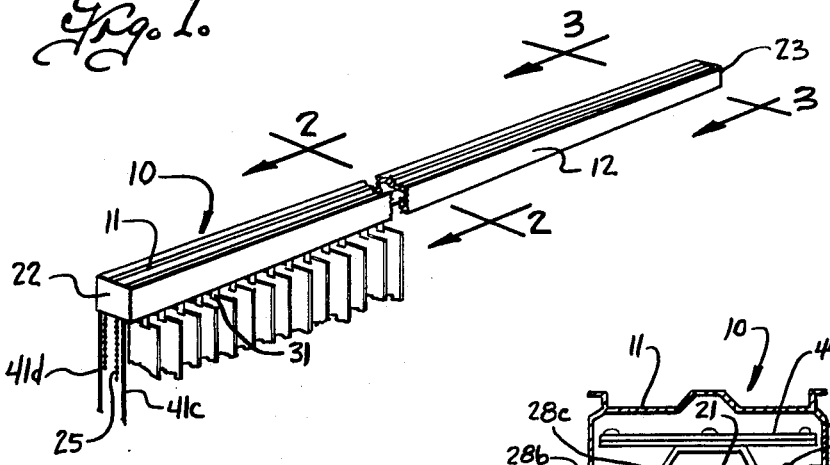
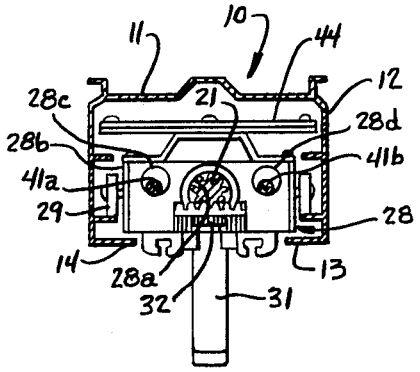
Fig. 2.
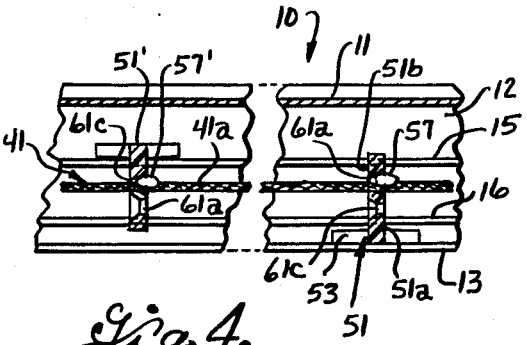
Fig. 4.
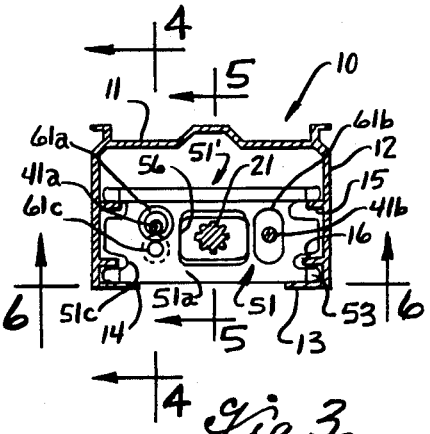
Fig. 3.
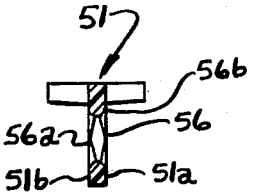
Fig. 5.
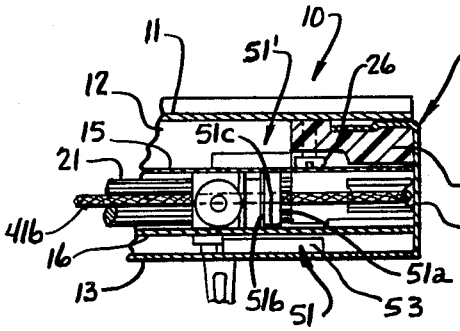
Fig. 8.

VERTICAL BLIND WITH MOVABLE AUXILIARY ROD SUPPORT

PRIOR ART

The invention relates to vertical blinds of the type having a horizontal carriage guide channel and slat support carriages movable along the channel having slat carriers mounted thereon for rotation about upright axes and operatively connected to a blind operating rod that extends lengthwise of the channel, to enable turning of the slat carriers in response to turning of the blind operating rod. The blind operating rod is rotatably supported by fixed rod support fittings at spaced locations along the channel. When the span between the fixed operating rod supports is long, it is known, for example as disclosed in U.S. Pat. Nos. 3,500,896; 4,122,184 and 4,332,288, to provide one or more auxiliary carriages that are movable along the rod to support the rod when the blind is in an open condition. When the blind is moved to a closed position, the lead slat carriage engages the auxiliary carriage and moves the latter along the rod to a position alongside one of the fixed rod supports. Since the auxiliary carriage or carriages are located between the lead carriage and the fixed rod support when the blind is in its closed position, they produce a dead space between the lead slat carriage and the fixed rod support fitting and can result in the production of an undesirable light gap when the blind is closed. In order to reduce the dead space, some auxiliary carriages have heretofore been made relatively thin, for example of the order of ⅛" in thickness. However, such a thin auxiliary carriage tends to tilt or cock when being traversed along the rod so that it binds on the operating rod or between the operating rod and track. This problem is aggravated in vertical blinds having longitudinally curved guide channels since the longitudinal curvature of the blind operating rod does not exactly match the longitudinal curvature of the channel.

BRIEF SUMMARY OF THE INVENTION

It is an object of the present invention to provide a vertical blind having a movable auxiliary carriage for supporting the blind operating rod when the blind is in an open condition, and which minimizes the dead space between the lead slat carriage and the fixed rod support when the blind is in a closed condition, while avoiding the problem of binding of the auxiliary carriage on the rod and channel during traversing of the auxiliary carriage along the channel.

Accordingly, the present invention provides a vertical blind including a generally horizontal carriage guide channel having at least first and second trackways extending lengthwise along the inner sides of each side wall of the channel, a blind operating rod extending lengthwise of the channel, first and second fixed rod supports for rotatably supporting the rod at first and second locations spaced along the channel, a plurality of slat carriages guidably mounted in the first trackway and each having slat carrier means operatively connected to the blind operating rod for turning thereby, and carriage traverse means for moving the lead slat carriage along the channel between a blind open and a blind closed position. At least one auxiliary carriage is provided in the channel intermediate the lead carriage and the first fixed rod support, and the auxiliary carriage has guide shoes at opposite ends extending from at least one of the side faces in a direction generally lengthwise of the channel and guidably supported in the second trackways on the channel for movement therealong. The lead slat carriage is adapted to engage the auxiliary carriage and move the latter along the channel to a position adjacent the first rod support, when the lead slat carriage is moved to a blind closed position, and means are provided for moving the auxiliary carriage along the channel to a position spaced from the first rod support means when the lead slat carriage is moved to a blind open position. The guide shoes on the auxiliary carriage are arranged to at least partially overlap at least one of the items comprising the lead slat carriage and the first rod support means when the blind is closed, to reduce the dead space between the lead slat carriage and the rod support means.

The guide shoes are preferably arranged to extend from both sides of the auxiliary carriage and to overlap portions of both the lead carriage and the rod support means when the blind is in a closed position.

The rod can be formed with three longitudinally extending trackways, one above and one below the trackway that supports the lead slat carriage, and multiple auxiliary carriages can be provided with one auxiliary carriage arranged in the channel with the guide shoes in the lower trackway and another auxiliary carriage arranged in the channel with the guide shoes in the upper trackway.

BRIEF DESCRIPTION OF THE DRAWINGS

FIG. 1 is a fragmentary perspective view of a vertical blind;

FIG. 2 is a transverse sectional view taken on the plane 2—2 of FIG. 1 and illustrating one of the slat support carriages in the carriage guide channel;

FIG. 3 is a transverse sectional view taken on the 3—3 of FIG. 1 and illustrating an auxiliary carriage in the guide channel;

FIG. 4 is a fragmentary longitudinal sectional view taken on the plane 4—4 of FIG. 3;

FIG. 5 is a sectional view taken on the plane 5—5 of FIG. 3, through one of the auxiliary carriers;

FIG. 8 is a fragmentary vertical sectional view taken on the plane 8—8 of FIG. 7.

DETAILED DESCRIPTION OF THE INVENTION

Figure 6:
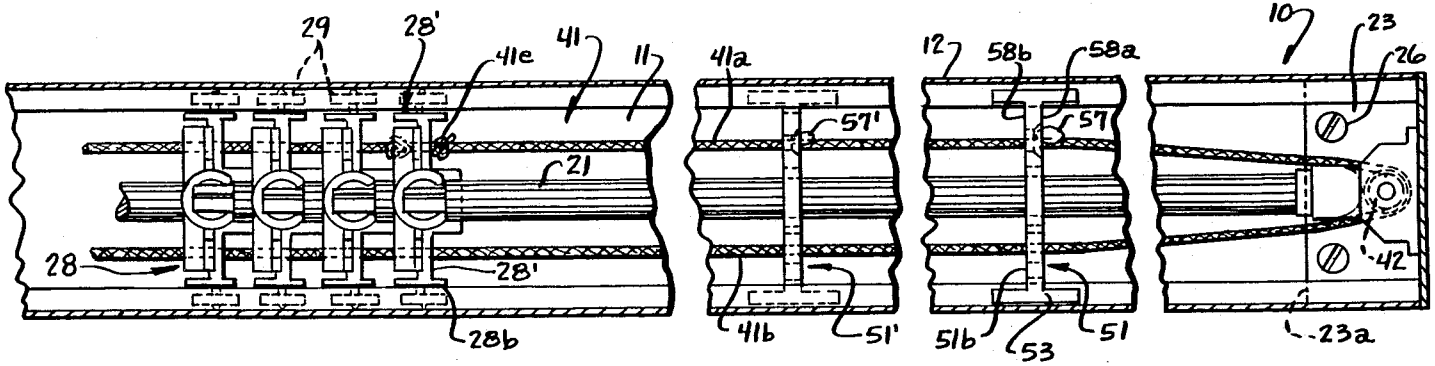
FIG. 6 is a fragmentary horizontal sectional view taken on the plane 6—6 of FIG. 3, illustrating the blind in an open condition.
Figure 7:
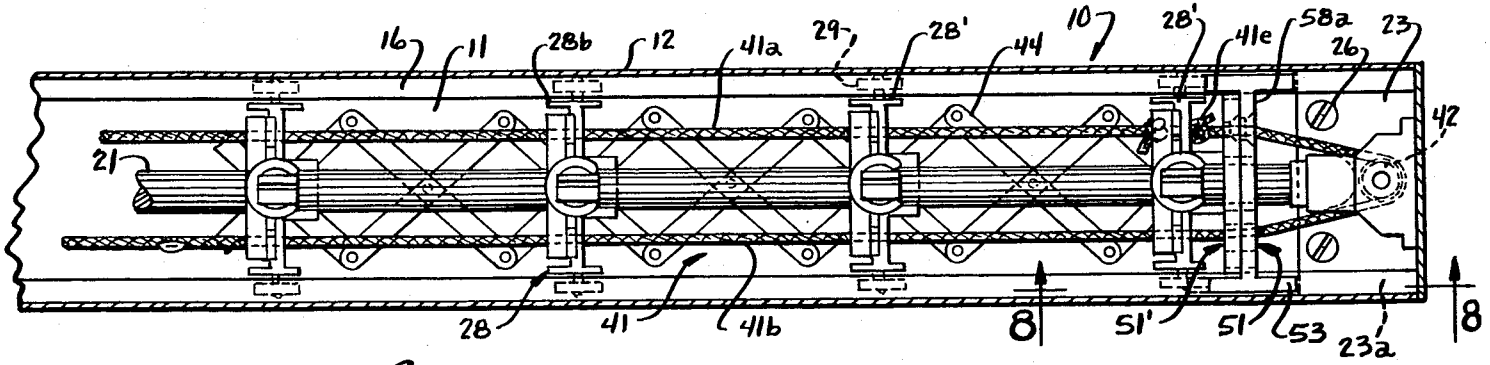
FIG. 7 is a fragmentary horizontal sectional view taken on the plane 6—6 of FIG. 3, illustrating the blind in a closed condition.

As shown, the vertical blind comprises a head rail in the form of a generally horizontal carriage guide channel 10 having a top wall 11, spaced side walls 12 and inwardly extending bottom flanges 13 on each side wall defining a lengthwise extending bottom opening 14 therebetween. The side walls each have lengthwise extending upper and lower flanges 15 and 16 intermediate the bottom flange and the top wall and which define a first lengthwise extending trackway between the upper and lower flanges 15 and 16, and a second lengthwise extending trackway between the lower flange 16 and the bottom flange 13, and a third lengthwise extending trackway between the upper flange 15 and the top wall 11. A blind operating rod 21 extends lengthwise of the channel and is rotatably supported by two or more fixed rod support fittings at spaced locations fixed along the channel. In the one-way draw vertical blind illustrated, the blind operating rod 21 is supported at one end of the channel by an end fitting 22 that houses the drive mechanism for rotating the operating rod, and at the other end by an end fitting 23. In multiple draw blinds, for example as disclosed in U.S. Pat. No. 4,332,288, the operating rod can be also supported by a fixed rod support fitting intermediate the ends of the channel. The rod operating mechanism 22 can be of any conventional construction and may, for example, be of the type disclosed in U.S. Pat. No. 4,657,060, and which includes a speed reducing mechanism for rotating an operating rod 21 in opposite directions in response to pulling one or the other vertical runs of an operating chain 25 (see FIG. 1). As best shown in FIGS. 6–8, the end fitting 23 at the other end of the channel has laterally extending end portions 23*a* that extend into the space between the upper flange 15 and the top wall 11, and the end fitting 23 is locked in position on the channel by screws 26 that engage the top wall of the channel.

A plurality of slat carriages 28 extend crosswise of the channel and have means such as wheels or rollers 29 at opposite ends that are guidably supported in the trackway between the upper and lower flanges 15 and 16 on the channel. The slat carriages have passages 28*a* therethrough for receiving and guidably supporting the operating rod 21, and end walls 28*b* that are spaced apart a distance slightly less than the spacing between the flanges 16 on opposed side walls to laterally guide the slat carriages during movement along the channel. A slat carrier 31 is mounted on each of the slat carriages for rotation relative thereto about an upright axis and a means 32 is provided on each of the carriages for drivingly connecting the slat carrier to the operating rod, to turn the slat carrier about an upright axis in response to rotation of the operating rod about its horizontal axis. The carrier rotating means shown is of the rack and pinion type such as disclosed in U.S. Pat. No. 4,122,884, it being understood that other carrier rotating such as the worm and worm wheel type, may also be used.

Traverse means 41 is provided for moving the lead one of the slat carriages designated 28' along the guide channel between a blind closed position and a blind open position. The traverse means can be arranged so that the lead carriage is adjacent either one of the fixed end fittings 22 or 23 in the blind closed position and spaced from that one of the end fittings in the blind open position. In the embodiment illustrated, the traverse means is of the cord type, it being understood that the lead carriage can also be moved along the channel by a traverse rod that extends lengthwise of the channel, for example as disclosed in U.S. Pat. No. 3,500,896. As is conventional in cord type traverse means, the traverse cord is looped around a traverse cord guide pulley 42 at one end of the channel and has first and second runs 41*a* and 41*b* that extend lengthwise of the channel and downwardly over guides (not shown) at the other end of the channel and which terminate in first and second traverse cord operating portions 41*c* and 41*d* (FIG. 1) that extend downwardly at one end of the channel. One run 41*a* of the traverse cord is attached as indicated at 41*e* (FIGS. 6 and 7) to the lead slat carrier 28', as by knots, cord locks or the like, and the run 41*a* extends therefrom loosely through openings 28*c* in the slat carriages 28, while the other run 41*b* extends loosely through openings 28*d* in all of the slat carriages. Thus, when one of the operating portions such as 41*c* is pulled downwardly, the lead slat carriage will be moved in one direction (to the right as viewed in FIG. 6) to a blind closed position and, when the other of the operating portions 41*d* is pulled downwardly, the lead slat carriage is moved in the other direction to a blind open position. Any suitable means may be provided for controlling the spacing between the lead slat carriage and the other slat carriages. In the embodiment illustrated, a pantograph mechanism 44 is provided and interconnects the several slat carriages to approximately equalize the spacing between the slat carriages during movement of the lead carriage between the open and closed positions. Alternatively, spacer links such as shown in U.S. Pat. No. 3,500,896 can be provided for controlling the maximum space between carriages.

The slat carriages underlie and support the operating rod and the runs of the traverse cord, when the blind is in a closed position. However, when the blind is in an open position, the portion of the operating rod and traverse cord between the lead carriage and the fixed rod support can sag or droop. One or more movable auxiliary carriages 51 are provided for supporting the operating rod intermediate the lead carriage and the fixed rod support, when the blind is in an open condition. The auxiliary carriages are made relatively thin as compared to the dimension of the slat carriages 28 measured in a direction lengthwise of the rod and may, for example be formed with a body having opposed side walls 51*a* and 51*b* spaced apart a distance of the order of $\frac{1}{8}''$. The auxiliary carriage 51 is provided with guide shoes 53 at opposite ends that extend from one and preferably both side faces 51*a* and 51*b* of the carriage in a direction generally lengthwise of the channel and at locations to be guidably supported in the lower trackway between the lower flange 16 and the bottom flange 13 or the thin body of the slat carriage is preferably configured so that the end portions of the thin body extend into the trackway between the upper and lower flanges 15 and 16, with notches 51*c* in each end to loosely receive the flange 16 on the channel. Since the guide shoes are vertically offset from the carriage guide wheels 29 that move in the trackway between the upper and lower flanges 15 and 16, the guide shoes on the auxiliary carriage can bypass and at least partially overlap the lead slat carriage when the blind is in a closed condition. The guide shoes have an overall length substantially greater than the thickness of the auxiliary carriage and sufficient to inhibit tilting or cocking of the auxiliary carriage either vertically or horizontally relative to the channel and operating rod, during movement of the auxiliary carriages along the guide channel. The guide shoes extend closely adjacent the side walls of the channel to be laterally guided thereby and the guide shoes have a vertical height slightly less than the spacing between the lower flange 16 and bottom flange 13 so as to be vertically guided thereby. With this arrangement, tilting of the auxiliary carriage relative to the channel and operating rod is effectively inhibited.

The auxiliary carriage is arranged to underlie and support the operating rod and, as best shown in FIGS. 3 and 5, the auxiliary carriage is provided with an opening 56 therethrough for the passage of the operating rod. In order to inhibit binding of the carriages on the operating rod, the opening 56 is horizontally elongated in a direction crosswise of the channel to provide generally horizontal lower and upper guide surfaces 56*a* and 56*b* that are preferably rounded in cross section as best shown in FIG. 5. This arrangement minimizes binding of the auxiliary carriages on the operating rod, and is particularly advantageous in longitudinally curved vertical blinds where the longitudinal curvature of the operating rod does not precisely match the longitudinal curvature of the guide channel.

The guide shoes 53 on the auxiliary carriage are also advantageously arranged to at least partially overlap the fixed rod support when the blind is in a closed condition. As previously described, the rod support end fitting 23 has portions 23*a* that extend into the space between the upper flange 15 and the top wall 11 of the channel. The auxiliary carriage 51 is arranged so that the guide shoes 53 move in the lower trackway, that is the trackway between the lower flange 16 and the bottom flange 13 so that the guide shoes on the auxiliary carriage can at least partially overlap the fixed rod support end fitting 23, when the blind is in a fully closed condition as shown in FIG. 8. When the traverse means is arranged to move the lead carriage to a position adjacent the other end fitting 22 in the blind closed position, the auxiliary carriage can similarly be arranged with the guide shoes in the lower trackway, to at least partially overlap the rod end fitting 22.

In very long rods, a second auxiliary carriage designated 51' can be provided for supporting the operating rod at a location intermediate the auxiliary carriage 51 and the lead slat carriage 28'. The second auxiliary carriage 51' can conveniently be the same as the auxiliary carriage 51, except that it is inverted so that the guide shoes 53 ride on the upper flanges 15 between the side walls of the channel and the notches 51*c* loosely receive the upper flange 15. With this arrangement, the guide shoes on the second auxiliary carriage are vertically offset from the guide wheels 29 on the slat carriages and also vertically offset from the shoes 53 on the auxiliary carriage 51, so that the guide shoes on the two auxiliary carriages 51, 51' can at least partially overlap each other, as shown in FIGS. 7 and 8.

When the blind is moved to a closed position, the lead slat carriage 28' engages the auxiliary carrier or carriers and moves the same along the guide toward a closed position alongside the fixed rod support 23. Provision is made for moving the auxiliary carriages to a position intermediate the ends of the channel, when the blind is moved to its open position. In the embodiment illustrated, the traverse means that moves the lead slat carriage 28' is also arranged to move the auxiliary carriage or carriages to positions intermediate the lead slat carriage and the fixed rod support 23. For this purpose, the auxiliary carriages are formed with a cord opening 61*a* at one side of the rod opening 56, which cord opening is arranged to loosely receive the run 41*a* of the traverse cord and a second cord opening 61*b* at the other side of the rod opening 56 for receiving the other run 41*b* of the traverse cord. The passage 61*a* is dimensioned to loosely receive the run 41*a*, and an enlargement such as a bead, sleeve or the like 57, of a size which will not pass through the opening 61*a*, is provided on the run 41*a* of the traverse cord at a location to engage the auxiliary carriage 51 and move it along the rod to a selected position intermediate the ends of the rod, when the blind is moved to its open position. The auxiliary carriage is also advantageously provided with a third cord opening 61*c* at the same side of the rod opening 56 as the cord opening 61*a* and vertically offset from the latter. The cord opening 61*c* is conveniently made the same size as the cord opening 61*a* and is adapted to receive the run 41*a* of the traverse cord, when a second auxiliary carriage is used and mounted in an inverted position with the shoes guided on the top flanges 15. When a second auxiliary carriage 51' is provided to support the blind operating rod, a second bead 57' is, provided on the cord for moving the second auxiliary carriage along the rod. One of the openings such as 61*a* in the second carriage 51' is reamed to a larger size to allow passage of one of the beads such as 57 therethrough and to engage the second one of the beads 57. The second bead 57' is spaced along the traverse cord from the lead carriage and from the first mentioned bead 57 to space the second auxiliary carriage 51' intermediate the first mentioned carriage 51 and the lead slat carriage 28', when the blind is in an open condition as shown in FIG. 6.

From the foregoing it is thought that the construction and operation of the vertical blind with the movable auxiliary carriage will be readily understood. The auxiliary carriage is relatively thin in cross section and has shoes at opposite ends that are guidably supported in a trackway that vertically offset from the trackway in which the slat carriages are supported, so that the guide shoes can overlap and permit the lead slat carriage to move closely adjacent the fixed rod support fitting, when the blind is in a closed condition. The shoes guidably support the auxiliary carriages to inhibit tilting and cocking of the carriage relative to the channel and operating rod. The auxiliary carriage is advantageously constructed so that the same carriage maybe used when multiple auxiliary carriages are required to support the blind operating rod. The auxiliary carriage is configured so that it can be guided in either a lower trackway below the trackway that supports the slat carriages or in an upper trackway above the trackway that supports the slat carriages. When multiple auxiliary carriages are used on a rod, the auxiliary carriages not only overlap the lead carriage and the end fitting but also overlap each other.

The embodiments of the invention in which an exclusive property or privilege is claimed are defined as follows:

1. A vertical blind comprising, a generally horizontal carriage guide channel having a top wall and spaced side walls and a lengthwise extending bottom opening, the guide channel having means defining a first trackway extending lengthwise along the inner side of each of the side walls and means defining a second trackway extending lengthwise along the inner side of each of the side walls and vertically offset from the first trackway on the associated side wall, a blind operating rod extending lengthwise of the guide channel and first and second fixed rod support means for rotatably supporting the rod at first and second locations fixed along the channel, a plurality of slat carriage extending crosswise of the channel and each having means at opposite ends guidably supported in the first trackway, the slat carriages each having slat carrier means mounted for turning movement relative thereto about a generally upright axis and means for drivingly connecting the slat carrier means to the blind operating rod for turning thereby, carriage traverse means for moving at least a lead one of the slat carriages along the channel between a blind closed position adjacent said first fixed rod support means and a blind open position spaced from the first fixed rod support means, at least one auxiliary carriage having opposed side faces extending crosswise of the channel intermediate the lead carriage and said first fixed rod support means, the auxiliary carriage having guide shoes at opposite ends extending from at least one of the side faces in a direction generally lengthwise of the channel and guidably supported in the second trackways, the auxiliary carriage having means adapted to underlie and support the operating rod, the lead slat carriage being adapted to extend contiguous to the auxiliary carriage when the lead slat carriage is in the blind closed position, means for moving the auxiliary carriage along the channel to a position spaced from the first fixed rod support means when the lead slat carriage is moved toward the blind open position, the guide shoes on the auxiliary carriage being arranged to at least partially overlap the led slat carriage when the lead slat carriage is in the blind closed position to minimize dead space between the lead slat carriage and the first fixed rod support means, the channel having means defining a third trackway extending lengthwise along the inner side of each of the side walls and vertically offset from the first and second trackways on the associated side wall, a secondary auxiliary carriage having opposed side faces extending crosswise of the channel and guide shoes at opposite ends extending from at least one of the side faces in a direction generally lengthwise of the channel and guidably supported in the third trackways, the guide shoes on the first mentioned auxiliary carriage and the second auxiliary carriage being arranged to at least partially overlap in a direction longitudinally of the channel when the blind is closed.

2. A vertical blind according to claim 1 wherein the auxiliary carriage has said guide shoes extending from both side faces.

3. A vertical blind according to claim 1 wherein the auxiliary carriage has guide shoes extending from both side faces and the guide shoes are arranged to at least partially overlap both the lead slat carriage and the first fixed rod support means in a direction longitudinally of the channel when the blind is closed.

4. A vertical blind according to claim 1 wherein said second trackways are disposed below the first trackways and the third trackways are disposed above the first trackways.

5. A vertical blind according to claim 1 wherein said means on the auxiliary carriage for supporting the blind operating rod comprises an opening through the auxiliary carriage intermediate its ends and having a width measured crosswise of the channel that is substantially greater than the cross section of the operating rod to accommodate variations in spacing between the operating rod and the side walls of the channel.

6. A vertical blind comprising, a generally horizontal carriage guide channel having a top wall and spaced side walls and inwardly extending bottom flanges on each side wall defining a lengthwise extending bottom opening therebetween, the side walls each having upper and lower lengthwise extending flanges intermediate the bottom flange and the top wall and defining a first lengthwise extending trackway between the upper and lower flanges and a second lengthwise extending trackway between the lower flange and the bottom flange and a third lengthwise extending trackway between the upper flange and the top wall, a blind operating rod extending lengthwise of the guide channel and first and second fixed rod support means for rotatably supporting the rod at first and second locations fixed along the channel, a plurality of slat carriages extending crosswise of the channel and each having means at opposite ends guidably supported in the first trackways, the slat carriages each having slat carrier means mounted for turning movement relative thereto about a generally upright axis and means for drivingly connecting the slat carrier means to the operating rod for turning thereby, carriage traverse means for moving at least a lead one of the slat carriages along the channel between a blind closed position adjacent said first fixed rod support means and a blind open position spaced from the first fixed rod support means, at least one auxiliary carriage having opposed side faces extending crosswise of the channel intermediate the lead carriage and the first fixed rod support means, the auxiliary carriage having guide shoes at opposite ends extending from at least one of the side faces in a direction generally lengthwise of the channel, the auxiliary carriage being reversibly positionable in the channel with the guide shoes guidably engaging either the bottom flanges or the upper flanges on the side walls of the channel, the auxiliary carriage having an opening therethrough defining a first rod support means adapted to underlie and support the operating rod when the guide shoes are positioned to guidably engage the bottom flanges and a second rod support means adapted to underlie and support the operating rod when the guide shoes are positioned to engage the upper flanges, the lead slat carriage being adapted to extend contiguous to the auxiliary carriage when the lead slat carriage is moved to the blind closed position, means for moving the auxiliary carriage along the channel to a position spaced from the first fixed rod support means when the lead slat carriage is moved toward the blind open position, the guide shoes on the auxiliary carriage when positioned to engage either the bottom flanges or the upper flanges being adapted to at least partially overlap the lead slat carriage when the blind is closed to reduce dead space between the lead slat carriage and the first fixed rod support means.

7. A vertical blind according to claim 6 wherein the auxiliary carriage has said guide shoes extending from both side faces.

8. A vertical blind according to claim 6 wherein the auxiliary carriage has said guide shoes extending from both side faces and the guide shoes are arranged to at least partially overlap both the lead slat carriage and the first fixed rod support means in a direction longitudinally of the channel when the blind is closed.

9. A vertical blind according to claim 6 wherein said first fixed rod support means is mounted in said third trackway at one end of the channel, the auxiliary carriage having guide shoes extending from both side faces and the guide shoes being arranged to at least partially overlap both the lead slat carriage and the first fixed rod support means in a direction longitudinally of the channel when the blind is closed.

10. A vertical blind according to claim 6 wherein two of said auxiliary carriages extend crosswise of the channel intermediate the lead carriage and the first fixed rod support means, one of the auxiliary carriages having the guide shoes thereon positioned to guidably engage the bottom flanges and the other of the auxiliary carriages having the guide shoes thereon positioned to guidably engage the top flanges, the guide shoes on the two auxiliary carriages being arranged to at least partially overlap in a direction longitudinally of the channel when the blind is closed.

11. A vertical blind according to claim 6 wherein said auxiliary carriage has end portions vertically offset from said guide shoes and extending into said first trackway, said end portions having a thickness measured in a direction lengthwise of said channel which is small as compared to the length of said guide shoes.

12. A vertical blind comprising, a generally horizontal carriage guide channel having a top wall and spaced side walls and inwardly extending bottom flanges on each side wall defining a lengthwise extending bottom opening therebetween, the side walls each having upper and lower lengthwise extending flanges intermediate the bottom flange and the top wall and defining a first lengthwise extending trackway between the upper and lower flanges and a second lengthwise extending trackway between the lower flange and the bottom flange and a third lengthwise extending trackway between the flange and the top wall, a blind operating rod extending lengthwise of the guide channel and first and second fixed rod support means for rotatably supporting the rod at first and second locations fixed along the channel, a plurality of slat carriages extending crosswise of the channel and each having means at opposite ends guidably supported in the first trackways, the slat carriage each having slat carrier means mounted for turning movement relative thereto about a generally upright axis and means for drivingly connecting the slat carrier means to the operating rod for turning thereby, carriage traverse means for moving at least a lead one of the slat carriages along the channel between a blind closed position adjacent said first fixed rod support means and a blind open position spaced from the first fixed rod support means, at least one auxiliary carriage having opposed side faces extending crosswise of the channel intermediate the lead carriage and the first fixed rod support means, the auxiliary carriage having guide shoes at opposite ends from at least one of the side faces in a direction generally lengthwise of the channel and guidably supported in the second trackways, the auxiliary carriage having means adapted to underlie and support the operating rod, the lead slat carriage being adapted to extend contiguous to the auxiliary carriage when the lead slat carriage is in the blind closed position, means for moving the auxiliary carriage along the channel to a position spaced from the first fixed rod support means when the lead slat carriage is moved to a blind open position, the guide shoes on the auxiliary carriage being arranged to at least partially overlap the lead slat carriage when the lead slat carriage is in blind closed position to reduce dead space between the lead slat carriage and the first fixed rod support means, a second auxiliary carriage having opposed side faces extending crosswise of the channel at a location between the first mentioned auxiliary carriage and the lead carriage, the second auxiliary carriage having guide shoes at opposite ends extending from at least one of the side faces in a direction generally lengthwise of the channel and guidably supported in the third trackways, the guide shoes in the first mentioned auxiliary carriage and the second auxiliary carriage being arranged to at least partially overlap in a direction longitudinally of the channel when the blind is closed.

* * * * *

UNITED STATES PATENT AND TRADEMARK OFFICE

CERTIFICATE OF CORRECTION

PATENT NO. : 4,848,434

DATED : July 18, 1989

INVENTOR(S) : John E. Morris; Ronald G. Darner

It is certified that error appears in the above-identified patent and that said Letters Patent is hereby corrected as shown below:

| | | |
|---|---|---|
| Claim 1, column 6, line 56, | | delete "carriage" and insert -- carriages --; |
| | line 58, | delete "trackway" and insert -- trackways --; |
| column 7, line 15, | | delete "led" and insert -- lead --; |
| Claim 12, column 9, line 21, | | delete "carriage" and insert -- carriages --; |
| column 10, line 4; | | insert -- extending -- before "from". |

Signed and Sealed this

Twenty-second Day of May, 1990

*Attest:*

HARRY F. MANBECK, JR.

*Attesting Officer*

*Commissioner of Patents and Trademarks*